US009447330B2

(12) United States Patent
Schlosberg et al.

(10) Patent No.: US 9,447,330 B2
(45) Date of Patent: Sep. 20, 2016

(54) PROCESS FOR PRODUCING CRUDE OIL AND BITUMEN PRODUCTS

(71) Applicant: EPIC OIL EXTRACTORS, LLC, Ponchatoula, LA (US)

(72) Inventors: Richard H. Schlosberg, Highland Park, IL (US); Richard D. Jordan, Vienna, VA (US); Edward L. Diefenthal, Metairie, LA (US)

(73) Assignee: Epic Oil Extractors, LLC, Ponchatoula, LA (US)

( * ) Notice: Subject to any disclaimer, the term of this patent is extended or adjusted under 35 U.S.C. 154(b) by 124 days.

(21) Appl. No.: 14/135,396

(22) Filed: Dec. 19, 2013

(65) Prior Publication Data

US 2015/0175892 A1 Jun. 25, 2015

(51) Int. Cl.
*C10G 1/04* (2006.01)

(52) U.S. Cl.
CPC ..... *C10G 1/045* (2013.01); *C10G 1/042* (2013.01)

(58) Field of Classification Search
CPC ..... C10G 1/04; C10G 1/045
See application file for complete search history.

(56) References Cited

U.S. PATENT DOCUMENTS

| | | | | |
|---|---|---|---|---|
| 4,160,718 | A * | 7/1979 | Rendall | C10G 1/04 196/14.52 |
| 2011/0174691 | A1* | 7/2011 | Reynolds | B01J 27/049 208/123 |
| 2011/0180459 | A1* | 7/2011 | Duyvesteyn | C10G 1/042 208/391 |
| 2013/0270156 | A1* | 10/2013 | Flegal | C10G 1/04 208/390 |

* cited by examiner

*Primary Examiner* — Brian McCaig
(74) *Attorney, Agent, or Firm* — Dickinson Wright PLLC

(57) ABSTRACT

Disclosed are processes for producing crude oil and bitumen products of relatively high quality from oil sand. The processes for producing the high quality crude oil and bitumen products involve a Phase I and/or Phase II extraction solvent. According to the Phase I process, a high quality bitumen-derived crude oil can be produced using a Phase I type solvent. According to the Phase II process, a substantial amount of the bitumen on the oil sand can be extracted using a Phase II type solvent, while producing a relatively dry tailings by-product. The Phase I and Phase II extraction processes can be carried out independently or in conjunction with one another.

33 Claims, No Drawings

PROCESS FOR PRODUCING CRUDE OIL AND BITUMEN PRODUCTS

This invention relates to a method for producing crude oil and bitumen products. In particular, this invention relates to producing crude oil and bitumen products from oil sand using hydrocarbon solvents.

BACKGROUND OF THE INVENTION

Along with Saudi Arabia and Venezuela, Canada has one of the world's major hydrocarbon resources. The Canadian resource, estimated to contain as much as 1.7 trillion barrels of heavy oil or bitumen, is largely found in the province of Athabasca in the form of oil sands.

Oil sands are a mixture of sands and other rock materials and contain crude bitumen. Currently about 1.5 million barrels of oil per day are generated from Canadian oil sands and much of that is transported to the United States for upgrading.

The majority of the oil sands processing is a combination of strip mining and a water-based extraction. Hugh quantities of water (2-4 barrels per barrel of oil) are required to obtain a single barrel of oil from the oil sands.

Oil sands companies are currently held to a zero-discharge policy by the Alberta Environmental Protection and Enhancement Act (1993). Thus, all oil sands process water produced must be held on site. This requirement has resulted in over a billion cubic meters of tailings water held in containment systems. Those that produce the tailings water have been held responsible for reclaiming the water and finding a way to release the reclaimed water back into the local environment.

Despite extensive programs that have led to significant improvements including up to 90+% use of recycled water, the tailings ponds and buildup of contaminants in the recycled water and in tailings ponds represent what is considered to be a fundamentally non-sustainable process.

Waterless approaches using hydrocarbon solvent extraction technology have been examined. These approaches offer a pathway to obtaining oil from oil sands that could be potentially low energy, water free, and environmentally superior to the current water-based technology.

U.S. Pat. No. 3,475,318 to Gable et al. is directed to a method of selectively removing oil from oil sands by solvent extraction with subsequent solvent recovery. The extraction solvent consists of a saturated hydrocarbon of from 5 to 9 carbon atoms per molecule. Volatile saturated solvents such as heptane, hexane and non-aromatic gasoline are used to selectively remove saturated and aromatic components of the bitumen from the oil sand, while leaving the asphaltenes on the sand. In order to remove the asphaltenes for process fuel, aromatic such as benzene or toluene is added to the solvent at a concentration of from 2 to 20 weight percent.

U.S. Pat. No. 4,347,118 to Funk et al. is directed to a solvent extraction process for tar sands, which uses a low boiling solvent having a normal boiling point of from 20° C. to 70° C. to extract the bitumen from the tar sands. The solvent is mixed with tar sands in a dissolution zone at a solvent:bitumen weight ratio of from about 0.5:1 to 2:1. This mixture is passed to a separation zone containing a classifier and countercurrent extraction column, which are used to separate bitumen and inorganic fines from extracted sand. The extracted sand is introduced into a first fluid-bed drying zone fluidized by heated solvent vapors, to remove unbound solvent from extracted sand and lower the water content of the sand to less than about 2 wt. %. The treated sand is then passed into a second fluid-bed drying zone fluidized by a heated inert gas to remove bound solvent. Recovered solvent is recycled to the dissolution zone.

U.S. Pat. No. 7,985,333 to Duyvesteyn is directed to a method for obtaining bitumen from tar sands. The method includes using multiple solvent extraction or leaching steps to separate the bitumen from the tar sands. A light aromatic solvent such as toluene, xylene, kerosene, diesel (including biodiesel), gas oil, light distillate, commercially available aromatic solvents such as Solvesso 100, 150, and 200, naphtha, benzene and aromatic alcohols can be used as a first solvent. A second hydrocarbon solvent, which includes aliphatic compounds having 3 to 9 carbon atoms and liquefied petroleum gas, can also be used in the extraction process.

U.S. Patent Pub. No. 2009/0294332 to Ryu discloses an oil extraction process that uses an extraction chamber and a hydrocarbon solvent rather than water to extract the oil from oil sand. The solvent is sprayed or otherwise injected onto the oil-bearing product, to leach oil out of the solid product resulting in a composition comprising a mixture of oil and solvent, which is conveyed to an oil-solvent separation chamber.

U.S. Patent Pub. No. 2010/0130386 to Chakrabarty discloses the use of a solvent for bitumen extraction. The solvent includes (a) a polar component, the polar component being a compound comprising a non-terminal carbonyl group; and (b) a non-polar component, the non-polar component being a substantially aliphatic substantially non-halogenated alkane. The solvent has a Hansen hydrogen bonding parameter of 0.3 to 1.7 and/or a volume ratio of (a):(b) in the range of 10:90 to 50:50.

U.S. Patent Pub. No. 2011/0094961 to Phillips discloses a process for separating a solute from a solute-bearing material. The solute can be bitumen and the solute-bearing material can be oil sand. A substantial amount of the bitumen can be extracted from the oil sand by contacting particles of the oil sand with globules of a hydrocarbon extraction solvent. The hydrocarbon extraction solvent is a $C_1$-$C_5$ hydrocarbon. The particle size of the oil sand and the globule size of the extraction solvent are balanced such that little if any bitumen or extraction solvent remains in the oil sand.

U.S. Patent Pub. No. 2012/0261313 to Diefenthal et al. is directed to a process for producing a crude oil composition from oil sand that uses a solvent comprised of a hydrocarbon mixture. The solvent is injected into a vessel and the oil sand is supplied to the vessel such that the solvent and oil sand contact one another in the vessel, i.e., contact zone of the vessel. The process is carried out such that not greater than 80 wt % of the bitumen is removed from the supplied oil sand, with the removal being controlled by the Hansen solubility blend parameters of the solvent and the vapor condition of the solvent in the contact zone. The extracted oil and at least a portion of the solvent are removed from the vessel for further processing as may be desired.

U.S. Patent Pub. No. 2013/0220890 to Ploemen et al. is directed to a method for extracting bitumen from an oil sand stream. The oil sand stream is contacted with a liquid comprising a solvent to obtain a solvent-diluted oil sand slurry. The solvent-diluted oil sand slurry is separated to obtain a solids-depleted stream and a solids-enriched stream. The solvent-to-bitumen weight ratio (S/B) of the solids-enriched stream is increased to produce a solids-enriched stream having an increased S/B weight ratio and a liquid stream. The solids-enriched stream having an increased S/B weight ratio is filtered to obtain the bitumen-depleted sand.

The solvent can include aromatic hydrocarbon solvents and saturated or unsaturated aliphatic hydrocarbon solvents.

There is a continuing need for waterless approaches using hydrocarbon solvent extraction technology to extract crude oil and bitumen products from oil sand. There is a particular need for obtaining high quality crude oil and obtaining relatively dry tailings from the hydrocarbon extraction processes.

SUMMARY OF THE INVENTION

This invention provides a waterless approach using hydrocarbon solvent extraction technology to extract crude oil and bitumen products from oil sand. The invention further provides a high quality crude product and produces relatively dry tailings from the hydrocarbon extraction process.

According to one aspect of the invention, there is provided a process for producing a bitumen-derived crude oil composition and a bitumen composition from an oil sands feedstock. The method includes a step of treating the oil sands feedstock with a first hydrocarbon solvent to produce the bitumen-derived crude oil composition. The oil sands feedstock can be comprised of at least 6 wt % bitumen based on total weight of the oil sands. The first hydrocarbon solvent can be comprised of at least one of $C_3$-$C_6$ paraffins and halogen-substituted $C_1$-$C_6$ paraffins.

The process can include a step of separating the bitumen-derived crude oil composition from the treated oil sands. The separated bitumen-derived crude oil composition can have an asphaltene content of not greater than 10 wt % pentane insolubles, measured according to ASTM D4055.

The process can further include a step of treating the treated oil sands with a second hydrocarbon solvent to produce a heavy bitumen composition. The second hydrocarbon solvent can be comprised of an admixture of aliphatic hydrocarbon and a fraction of the bitumen-derived crude oil composition.

The first hydrocarbon solvent can have a Hansen hydrogen bonding blend parameter of not greater than 0.5. Alternatively, or in addition, the first hydrocarbon solvent can have a Hansen polarity blend parameter of not greater than 1. Alternatively, or additionally, the first hydrocarbon solvent can have a Hansen dispersion blend parameter of less than 16.

The first hydrocarbon solvent can include one or more ketones. For example, the first hydrocarbon solvent can have a ketone content of less than 5 wt %.

The first hydrocarbon solvent can further include one or more aromatic compounds. For example, the first hydrocarbon solvent can have an aromatic content of less than 5 wt %.

The second hydrocarbon solvent can include one or more aliphatic hydrocarbons. For example, the second hydrocarbon solvent can be comprised of paraffins and/or halogen-substituted paraffins, such as at least one of $C_3$-$C_6$ paraffins and halogen-substituted $C_1$-$C_6$ paraffins.

In one embodiment of the invention, each Hansen solubility parameter of the second hydrocarbon solvent is higher than that of the first solvent. At least one Hansen solubility parameter of the second hydrocarbon solvent is higher than the corresponding Hansen solubility of the first solvent.

In another embodiment, at least one Hansen solubility parameter of the second hydrocarbon solvent is higher than the corresponding Hansen solubility of the first solvent. Preferably, none of the Hansen solubility parameters of the second solvent is less than the corresponding Hansen parameter of the first solvent.

The second hydrocarbon solvent can have a Hansen hydrogen bonding blend parameter of at least 0.2. Alternatively, or in addition, the second hydrocarbon solvent has a Hansen polarity blend parameter of at least 0.2. Alternatively, or additionally, the second hydrocarbon solvent has a Hansen dispersion blend parameter of at least 14.

According to another aspect of the invention, there is provided a process for producing a bitumen composition from an oil sands feedstock, in which the process includes a step of treating the oil sands feedstock with a hydrocarbon solvent to produce the bitumen composition, in which the hydrocarbon solvent is comprised of an admixture of at least one of $C_3$-$C_6$ paraffins and halogen-substituted $C_1$-$C_6$ paraffins, preferably at least one $C_3$-$C_6$ paraffin such as propane, butane, pentane and/or hexane, and a bitumen-derived crude oil having an asphaltene content of not greater than 10 wt %. A step of separating the bitumen composition from the treated oil sands can be included in the process.

The hydrocarbon solvent used to produce the bitumen composition can have a Hansen hydrogen bonding blend parameter of at least 0.2. Alternatively, or in addition, the hydrocarbon solvent can have a Hansen polarity blend parameter of at least 0.2. Alternatively, or additionally, the hydrocarbon solvent can have a Hansen dispersion blend parameter of at least 14.

The hydrocarbon solvent used to produce the bitumen composition can be comprised of from 95 wt % to 5 wt % of the at least one of $C_3$-$C_6$ paraffins and halogen-substituted $C_1$-$C_6$ paraffins and from 5 wt % to 95 wt % of the bitumen-derived crude oil. The hydrocarbon solvent can be characterized by having a Hansen hydrogen bonding blend parameter of at least 0.2; alternatively, or in addition, a Hansen polarity blend parameter of at least 0.2; alternatively, or additionally, a Hansen dispersion blend parameter of at least 14. In one embodiment, the hydrocarbon solvent has an ASTM D7169 IBP of not greater than 100° C. The hydrocarbon solvent can have an ASTM D7169 50% distillation point within the range of from 100° C. to 450° C.

DETAILED DESCRIPTION OF THE INVENTION

Phase I and Phase II Processing of Oil Sand

This invention provides processes for producing crude oil and bitumen products of relatively high quality from oil sand. The crude oil and bitumen production processes are much more environmentally friendly than known processes for producing bitumen products from oil sand.

The processes for producing the high quality bitumen-derived crude oil and bitumen products involve a Phase I and/or Phase II extraction process using hydrocarbon solvents especially suited for producing the respective products. According to the Phase I process, a high quality bitumen-derived crude oil can be produced. According to the Phase II process, a substantial amount of the bitumen on the oil sand can be extracted, while producing a relatively dry tailings by-product. The Phase I and Phase II extraction processes can be carried out independently or in conjunction with one another.

Oil Sand

Crude oil and bitumen products can be extracted from any oil sand according to this invention. The oil sand can also be referred to as tar sand or bitumen sand. Additionally, the oil sand can be characterized as being comprised of a porous mineral structure, which contains an oil component. The entire oil content of the oil sand can be referred to as bitumen.

One example of an oil sand from which a crude oil product, as well as a bitumen product relatively high in asphaltenes content, can be produced according to this invention can be referred to as water wet oil sand, such as that generally found in the Athabasca deposit of Canada. Such oil sand can be comprised of mineral particles surrounded by an envelope of water, which may be referred to as connate water. The raw bitumen material of such water wet oil sand may not be in direct physical contact with the mineral particles, but rather formed as a relatively thin film that surrounds a water envelope around the mineral particles.

Another example of oil sand from which a crude oil composition, as well as a bitumen product relatively high in asphaltenes content, can be produced according to this invention can be referred to as oil wet oil sand, such as that generally found in Utah. Such oil sand may also include water. However, these materials may not include a water envelope barrier between the raw bitumen material and the mineral particles. Rather, the oil wet oil sand can comprise bitumen in direct physical contact with the mineral component of the oil sand.

In one aspect of the invention, a feed stream of oil sand is supplied to a contact zone, with the oil sand being comprised of at least 2 wt % of an oil composition, based on total weight of the supplied oil sand. Preferably, the oil sand feed is comprised of at least 4 wt % of an oil composition, more preferably at least 6 wt % of an oil composition, still more preferably at least 8 wt % of an oil composition, based on total weight of the oil sand feed. The oil composition on the oil sand feed refers to total hydrocarbon content of the oil sand feed, which can be determined according to the standard Dean Stark method.

Oil sand can have a tendency to clump due to some stickiness characteristics of the oil component of the oil sand. The oil sand that is fed to the contact zone should not be stuck together such that fluidization of the oil sand in the contact zone or extraction of the oil component in the contact zone is significantly impeded. In one embodiment, the oil sand that is provided or fed to the contact zone has an average particle size of not greater than 20,000 microns. Alternatively, the oil sand that is provided or fed to the contact zone has an average particle size of not greater than 10,000 microns, or not greater than 5,000 microns, or not greater than 2,500 microns.

As a practical matter, the particle size of the oil sand feed material should not be extremely small. For example, it is preferred to have an average particle size of at least 100 microns.

Extraction of High Quality Crude

High quality bitumen-derived crude oil can be extracted from oil sand using a Phase I type solvent. The Phase I solvent can be comprised of a hydrocarbon mixture, and the mixture can be comprised of at least two, or at least three or at least four different hydrocarbons.

The term "hydrocarbon" refers to any chemical compound that is comprised of at least one hydrogen and at least one carbon atom covalently bonded to one another (C—H). Preferably, the Phase I solvent is comprised of at least 40 wt % hydrocarbon. Alternatively, the Phase I solvent is comprised of at least 60 wt % hydrocarbon, or at least 80 wt % hydrocarbon, or at least 90 wt % hydrocarbon.

The Phase I solvent can further comprise hydrogen or inert components. The inert components are considered compounds that are substantially unreactive with the hydrocarbon component or the oil components of the oil sand at the conditions at which the solvent is used in any of the steps of the process of the invention. Examples of such inert components include, but are not limited to, nitrogen and water, including water in the form of steam. Hydrogen, however, may or may not be reactive with the hydrocarbon or oil components of the oil sand, depending upon the conditions at which the solvent is used in any of the steps of the process of the invention.

Treatment of the oil sand with the Phase I solvent is carried out as a vapor state treatment. For example, at least a portion of the Phase I solvent in the vessel, which serves as a contact zone for the solvent and oil sand, is in the vapor state. In one embodiment, at least 20 wt % of the Phase I solvent in the contact zone is in the vapor state. Alternatively, at least 40 wt %, or at least 60 wt %, or at least 80 wt % of the Phase I solvent in the contact zone is in the vapor state.

The hydrocarbon of the Phase I solvent can be comprised of a mix of hydrocarbon compounds. The hydrocarbon compounds can range from 1 to 20 carbon atoms. In an alternative embodiment, the hydrocarbon of the solvent is comprised of a mixture of hydrocarbon compounds having from 1 to 15, alternatively from 1 to 10, carbon atoms. Examples of such hydrocarbons include aliphatic hydrocarbons, olefinic hydrocarbons and aromatic hydrocarbons. Particular aliphatic hydrocarbons include $C_3$-$C_6$ paraffins, as well as halogen-substituted $C_1$-$C_6$ or $C_3$-$C_6$ paraffins. Examples of particular $C_3$-$C_6$ paraffins include, but are not limited to propane, butane, pentane and hexane, in which the terms "butane," "pentane" and "hexane" refer to at least one linear or branched butane, pentane or hexane, respectively. For example, the hydrocarbon solvent can be comprised of a majority, or at least 60 wt %, or at least 80 wt %, or at least 90 wt %, of at least one of propane, butane, pentane, and hexane. Examples of $C_1$-$C_6$ halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins.

The hydrocarbon component of the Phase I solvent can be selected according to the amount of bitumen component that is desired to be extracted from the oil sand feed, and according to the desired asphaltene content of the extracted bitumen component. The degree of extraction can be determined according to the amount of bitumen that remains with the oil sand following treatment or extraction. This can be determined according to the Dean Stark process.

The asphaltene content of the extracted bitumen or bitumen-derived oil using a Phase I type solvent can be determined according to ASTM D6560-00(2005) Standard Test Method for Determination of Asphaltenes (Heptane Insolubles) in Crude Petroleum and Petroleum Products.

In general, the Phase I solvent extracts a bitumen fraction or bitumen-derived crude oil composition from the oil sand in which the Phase I solvent-extracted crude oil composition is low in asphaltene content. Particularly effective hydrocarbons for use as the solvent according to the Phase I extraction can be classified according to Hansen solubility parameters, which is a three component set of parameters that takes into account a compound's dispersion force, polarity, and hydrogen bonding force. The Hansen solubility parameters are, therefore, each defined as a dispersion parameter (D), polarity parameter (P), and hydrogen bonding parameter (H). These parameters are listed for numerous compounds and can be found in *Hansen Solubility Parameters in Practice*—Complete with software, data, and examples, Steven Abbott, Charles M. Hansen and Hiroshi Yamamoto, 3rd ed., 2010, ISBN: 9780955122026, the contents of which are incorporated herein by reference. Examples of the Hansen solubility parameters are shown in Tables 1-12.

TABLE 1

| | Hansen Parameter | | |
|---|---|---|---|
| Alkanes | D | P | H |
| Propane | 13.9 | 0 | 0 |
| n-Butane | 14.1 | 0.0 | 0.0 |
| n-Pentane | 14.5 | 0.0 | 0.0 |
| n-Hexane | 14.9 | 0.0 | 0.0 |
| n-Heptane | 15.3 | 0.0 | 0.0 |
| n-Octane | 15.5 | 0.0 | 0.0 |
| Isooctane | 14.3 | 0.0 | 0.0 |
| n-Dodecane | 16.0 | 0.0 | 0.0 |
| Cyclohexane | 16.8 | 0.0 | 0.2 |
| Methylcyclohexane | 16.0 | 0.0 | 0.0 |

TABLE 2

| | Hansen Parameter | | |
|---|---|---|---|
| Aromatics | D | P | H |
| Benzene | 18.4 | 0.0 | 2.0 |
| Toluene | 18.0 | 1.4 | 2.0 |
| Naphthalene | 19.2 | 2.0 | 5.9 |
| Styrene | 18.6 | 1.0 | 4.1 |
| o-Xylene | 17.8 | 1.0 | 3.1 |
| Ethyl benzene | 17.8 | 0.6 | 1.4 |
| p-Diethyl benzene | 18.0 | 0.0 | 0.6 |

TABLE 3

| | Hansen Parameter | | |
|---|---|---|---|
| Halohydrocarbons | D | P | H |
| Chloromethane | 15.3 | 6.1 | 3.9 |
| Methylene chloride | 18.2 | 6.3 | 6.1 |
| 1,1 Dichloroethylene | 17.0 | 6.8 | 4.5 |
| Ethylene dichloride | 19.0 | 7.4 | 4.1 |
| Chloroform | 17.8 | 3.1 | 5.7 |
| 1,1 Dichloroethane | 16.6 | 8.2 | 0.4 |
| Trichloroethylene | 18.0 | 3.1 | 5.3 |
| Carbon tetrachloride | 17.8 | 0.0 | 0.6 |
| Chlorobenzene | 19.0 | 4.3 | 2.0 |
| o-Dichlorobenzene | 19.2 | 6.3 | 3.3 |
| 1,1,2 Trichlorotrifluoroethane | 14.7 | 1.6 | 0.0 |

TABLE 4

| | Hansen Parameter | | |
|---|---|---|---|
| Ethers | D | P | H |
| Tetrahydrofuran | 16.8 | 5.7 | 8.0 |
| 1,4 Dioxane | 19.0 | 1.8 | 7.4 |
| Diethyl ether | 14.5 | 2.9 | 5.1 |
| Dibenzyl ether | 17.4 | 3.7 | 7.4 |

TABLE 5

| | Hansen Parameter | | |
|---|---|---|---|
| Ketones | D | P | H |
| Acetone | 15.5 | 10.4 | 7.0 |
| Methyl ethyl ketone | 16.0 | 9.0 | 5.1 |
| Cyclohexanone | 17.8 | 6.3 | 5.1 |
| Diethyl ketone | 15.8 | 7.6 | 4.7 |
| Acetophenone | 19.6 | 8.6 | 3.7 |
| Methyl isobutyl ketone | 15.3 | 6.1 | 4.1 |
| Methyl isoamyl ketone | 16.0 | 5.7 | 4.1 |
| Isophorone | 16.6 | 8.2 | 7.4 |
| Di-(isobutyl) ketone | 16.0 | 3.7 | 4.1 |

TABLE 6

| | Hansen Parameter | | |
|---|---|---|---|
| Esters | D | P | H |
| Ethylene carbonate | 19.4 | 21.7 | 5.1 |
| Methyl acetate | 15.5 | 7.2 | 7.6 |
| Ethyl formate | 15.5 | 7.2 | 7.6 |
| Propylene 1,2 carbonate | 20.0 | 18.0 | 4.1 |
| Ethyl acetate | 15.8 | 5.3 | 7.2 |
| Diethyl carbonate | 16.6 | 3.1 | 6.1 |
| Diethyl sulfate | 15.8 | 14.7 | 7.2 |
| n-Butyl acetate | 15.8 | 3.7 | 6.3 |
| Isobutyl acetate | 15.1 | 3.7 | 6.3 |
| 2-Ethoxyethyl acetate | 16.0 | 4.7 | 10.6 |
| Isoamyl acetate | 15.3 | 3.1 | 7.0 |
| Isobutyl isobutyrate | 15.1 | 2.9 | 5.9 |

TABLE 7

| | Hansen Parameter | | |
|---|---|---|---|
| Nitrogen Compounds | D | P | H |
| Nitromethane | 15.8 | 18.8 | 5.1 |
| Nitroethane | 16.0 | 15.5 | 4.5 |
| 2-Nitropropane | 16.2 | 12.1 | 4.1 |
| Nitrobenzene | 20.0 | 8.6 | 4.1 |
| Ethanolamine | 17.2 | 15.6 | 21.3 |
| Ethylene diamine | 16.6 | 8.8 | 17.0 |
| Pyridine | 19.0 | 8.8 | 5.9 |
| Morpholine | 18.8 | 4.9 | 9.2 |
| Aniline | 19.4 | 5.1 | 10 |
| N-Methyl-2-pyrrolidone | 18.0 | 12.3 | 7.2 |
| Cyclohexylamine | 17.4 | 3.1 | 6.6 |
| Quinoline | 19.4 | 7.0 | 7.6 |
| Formamide | 17.2 | 26.2 | 19.0 |
| N,N-Dimethylformamide | 17.4 | 13.7 | 11.3 |

TABLE 8

| | Hansen Parameter | | |
|---|---|---|---|
| Sulfur Compounds | D | P | H |
| Carbon disulfide | 20.5 | 0.0 | 0.6 |
| Dimethylsulfoxide | 18.4 | 16.4 | 10.2 |
| Ethanethiol | 15.8 | 6.6 | 7.2 |

TABLE 9

| Alcohols | Hansen Parameter D | P | H |
|---|---|---|---|
| Methanol | 15.1 | 12.3 | 22.3 |
| Ethanol | 15.8 | 8.8 | 19.4 |
| Allyl alcohol | 16.2 | 10.8 | 16.8 |
| 1-Propanol | 16.0 | 6.8 | 17.4 |
| 2-Propanol | 15.8 | 6.1 | 16.4 |
| 1-Butanol | 16.0 | 5.7 | 15.8 |
| 2-Butanol | 15.8 | 5.7 | 14.5 |
| Isobutanol | 15.1 | 5.7 | 16.0 |
| Benzyl alcohol | 18.4 | 6.3 | 13.7 |
| Cyclohexanol | 17.4 | 4.1 | 13.5 |
| Diacetone alcohol | 15.8 | 8.2 | 10.8 |
| Ethylene glycol monoethyl ether | 16.2 | 9.2 | 14.3 |
| Diethylene glycol monomethyl ether | 16.2 | 7.8 | 12.7 |
| Diethylene glycol monoethyl ether | 16.2 | 9.2 | 12.3 |
| Ethylene glycol monobutyl ether | 16.0 | 5.1 | 12.3 |
| Diethylene glycol monobutyl ether | 16.0 | 7.0 | 10.6 |
| 1-Decanol | 17.6 | 2.7 | 10.0 |

TABLE 10

| Acids | Hansen Parameter D | P | H |
|---|---|---|---|
| Formic acid | 14.3 | 11.9 | 16.6 |
| Acetic acid | 14.5 | 8.0 | 13.5 |
| Benzoic acid | 18.2 | 7.0 | 9.8 |
| Oleic acid | 14.3 | 3.1 | 14.3 |
| Stearic acid | 16.4 | 3.3 | 5.5 |

TABLE 11

| Phenols | Hansen Parameter D | P | H |
|---|---|---|---|
| Phenol | 18.0 | 5.9 | 14.9 |
| Resorcinol | 18.0 | 8.4 | 21.1 |
| m-Cresol | 18.0 | 5.1 | 12.9 |
| Methyl salicylate | 16.0 | 8.0 | 12.3 |

TABLE 12

| Polyhydric alcohols | Hansen Parameter D | P | H |
|---|---|---|---|
| Ethylene glycol | 17.0 | 11.0 | 26.0 |
| Glycerol | 17.4 | 12.1 | 29.3 |
| Propylene glycol | 16.8 | 9.4 | 23.3 |
| Diethylene glycol | 16.2 | 14.7 | 20.5 |
| Triethylene glycol | 16.0 | 12.5 | 18.6 |
| Dipropylene glycol | 16.0 | 20.3 | 18.4 |

According to the Hansen Solubility Parameter System, a mathematical mixing rule can be applied in order to derive or calculate the respective Hansen parameters for a blend of hydrocarbons from knowledge of the respective parameters of each hydrocarbon component and the volume fraction of the hydrocarbon component. Thus according to this mixing rule:

$$D\text{blend}=\Sigma Vi\cdot Di,$$

$$P\text{blend}=\Sigma Vi\cdot Pi,$$

$$H\text{blend}=\Sigma Vi\cdot Hi,$$

where Dblend is the Hansen dispersion parameter of the blend, Di is the Hansen dispersion parameter for component i in the blend; Pblend is the Hansen polarity parameter of the blend, Pi is Hansen polarity parameter for component i in the blend, Hblend is the Hansen hydrogen bonding parameter of the blend, Hi is the Hansen hydrogen bonding parameter for component i in the blend, Vi is the volume fraction for component i in the blend, and summation is over all i components in the blend.

The Hansen parameters of the Phase I solvent, as well as the Phase II solvent described below, can be defined according to the mathematical mixing rule. The Phase I solvent can be essentially pure or it can be comprised of a blend of hydrocarbon compounds, and can optionally include limited amounts of non-hydrocarbons. In cases when non-hydrocarbon compounds are included in the Phase I solvent, as well as the Phase II solvent described below, the Hansen solubility parameters of the non-hydrocarbon compounds should also be taken into account according to the mathematical mixing rule. Thus, reference to Hansen solubility blend parameters of the Phase I and Phase II solvents takes into account the Hansen parameters of all the compounds present. Of course, it may not be practical to account for every compound present in the solvent. In such complex cases, the Hansen solubility blend parameters can be determined according to *Hansen Solubility Parameters in Practice*. See, e.g., Chapter 3, pp. 15-18, and Chapter 8, pp. 43-46, for further description.

The Phase I solvent is selected to limit the amount of asphaltenes that are extracted from oil sand in the Phase I extraction. The more desirable Phase I solvents have Hansen blend parameters that are relatively low. Lower values for the Hansen dispersion blend parameter and/or the Hansen polarity blend parameter are particularly preferred. Especially desirable solvents have low Hansen dispersion blend and Hansen polarity blend parameters.

The Hansen dispersion blend parameter of the Phase I solvent is desirably less than 16. In general, lower dispersion blend parameters are particularly desirable. As an example, the Phase I solvent is comprised of a hydrocarbon mixture, with the Phase I solvent having a Hansen dispersion blend parameter of not greater than 15. Additional examples include Phase I solvents comprised of a hydrocarbon mixture, with the solvent having a Hansen dispersion blend parameter of from 13 to 16 or from 13 to 15.

The Hansen polarity blend parameter of the Phase I solvent is desirably less than 2. In general, lower polarity blend parameters are particularly desirable. It is further desirable to use Phase I solvents that have both low Hansen dispersion blend parameters, as defined above, along with the low Hansen polarity blend parameters. As an example of low polarity blend parameters, the Phase I solvent is comprised of a hydrocarbon mixture, with the Phase I solvent having a Hansen polarity blend parameter of not greater than 1, alternatively not greater than 0.5, or not greater than 0.1. Additional examples include Phase I solvents comprised of a hydrocarbon mixture, with the solvent having a Hansen polarity blend parameter of from 0 to 2 or from 0 to 1.5 or from 0 to 1 or from 0 to 0.5 or from 0 to 0.1.

The Hansen hydrogen bonding blend parameter of the Phase I solvent is desirably less than 2. In general, lower hydrogen bonding blend parameters are particularly desirable. It is further desirable to use Phase I solvents that have low Hansen dispersion blend parameters and Hansen polarity blend parameters, as defined above, along with the low Hansen hydrogen bonding blend parameters. As an example of low hydrogen bonding blend parameters, the Phase I solvent is comprised of a hydrocarbon mixture, with the Phase I solvent having a Hansen hydrogen bonding blend parameter of not greater than 1, alternatively not greater than 0.5, or not greater than 0.1, or not greater than 0.05. Additional examples include Phase I solvents comprised of a hydrocarbon mixture, with the Phase I solvent having a Hansen hydrogen bonding blend parameter of from 0 to 1 or from 0 to 0.5 or from 0 to 0.1 or from 0 to 0.05.

The Phase I solvent can be a blend of relatively low boiling point compounds. In a case in which the Phase I solvent is a blend of compounds, the boiling range of Phase I solvent compounds can be determined by batch distillation according to ASTM D86-09e1, Standard Test Method for Distillation of Petroleum Products at Atmospheric Pressure.

In one embodiment, the Phase I solvent has an ASTM D86 10% distillation point of greater than or equal to −45° C. Alternatively, the Phase I solvent has an ASTM D86 10% distillation point of greater than or equal to −40° C., or greater than or equal to −30° C. The Phase I solvent can have an ASTM D86 10% distillation point within the range of from −45° C. to 50° C., alternatively within the range of from −35° C. to 45° C., or from −20° C. to 40° C.

The Phase I solvent can have an ASTM D86 90% distillation point of not greater than 300° C. Alternatively, the Phase I solvent can have an ASTM D86 90% distillation point of not greater than 200° C., or not greater than 100° C.

The Phase I solvent can have a significant difference between its ASTM D86 90% distillation point and its ASTM D86 10% distillation point. For example, the Phase I solvent can have a difference of at least 5° C. between its ASTM D86 90% distillation point and its ASTM D86 10% distillation point, alternatively a difference of at least 10° C., or at least 15° C. However, the difference between the solvent's Phase I ASTM D86 90% distillation point and ASTM D86 10% distillation point should not be so great such that efficient recovery of solvent from extracted crude is impeded. For example, the Phase I solvent can have a difference of not greater than 60° C. between its ASTM D86 90% distillation point and its ASTM D86 10% distillation point, alternatively a difference of not greater than 40° C., or not greater than 20° C.

Solvents high in aromatic content are not particularly desirable as Phase I solvents. For example, the Phase I solvent can have an aromatic content of not greater than 10 wt %, alternatively not greater than 5 wt %, or not greater than 3 wt %, or not greater than 2 wt %, based on total weight of the solvent injected into the extraction vessel. The aromatic content can be determined according to test method ASTM D6591-06 Standard Test Method for Determination of Aromatic Hydrocarbon Types in Middle Distillates-High Performance Liquid Chromatography Method with Refractive Index Detection.

Solvents high in ketone content are also not particularly desirable as Phase I solvents. For example, the Phase I solvent can have a ketone content of not greater than 10 wt %, alternatively not greater than 5 wt %, or not greater than 2 wt %, based on total weight of the solvent injected into the extraction vessel. The ketone content can be determined according to test method ASTM D4423-10 Standard Test Method for Determination of Carbonyls in $C_4$ Hydrocarbons.

In one embodiment, the Phase I solvent can be comprised of hydrocarbon in which at least 60 wt % of the hydrocarbon is aliphatic hydrocarbon, based on total weight of the solvent. Alternatively, the solvent can be comprised of hydrocarbon in which at least 70 wt %, or at least 80 wt %, or at least 90 wt % of the hydrocarbon is aliphatic hydrocarbon, based on total weight of the solvent. Particular examples of aliphatic hydrocarbons include $C_3$-$C_6$ paraffins, as well as halogen-substituted $C_1$-$C_6$ or $C_3$-$C_6$ paraffins, as previously described.

The Phase I solvent preferably does not include substantial amounts of non-hydrocarbon compounds. Non-hydrocarbon compounds are considered chemical compounds that do not contain any C—H bonds. Examples of non-hydrocarbon compounds include, but are not limited to, hydrogen, nitrogen, water and the noble gases, such as helium, neon and argon. For example, the Phase I solvent preferably includes not greater than 20 wt %, alternatively not greater than 10 wt %, alternatively not greater than 5 wt %, non-hydrocarbon compounds, based on total weight of the solvent injected into the extraction vessel.

Solvent to oil sand feed ratios can vary according to a variety of variables. Such variables include amount of hydrocarbon mix in the Phase I solvent, temperature and pressure of the contact zone, and contact time of hydrocarbon mix and oil sand in the contact zone. Preferably, the Phase I solvent and oil sand is supplied to the contact zone of the extraction vessel at a weight ratio of total hydrocarbon in the solvent to oil sand feed of at least 0.01:1, or at least 0.1:1, or at least 0.5:1 or at least 1:1. Very large total hydrocarbon to oil sand ratios are not required. For example, the Phase I solvent and oil sand can be supplied to the contact zone of the extraction vessel at a weight ratio of total hydrocarbon in the solvent to oil sand feed of not greater than 4:1, or 3:1, or 2:1.

Extraction of oil compounds from the oil sand in the Phase I extraction of crude oil from the bitumen is carried out in a contact zone such as in a vessel having a zone in which the Phase I solvent contacts the oil sand. Any type of extraction vessel can be used that is capable of providing contact between the oil sand and the solvent such that a portion of the oil is removed from the oil sand. For example, horizontal or vertical type extractors can be used. The solid can be moved through the extractor by pumping, such as by auger-type movement, or by fluidized type of flow, such as free fall or free flow arrangements. An example of an auger-type system is described in U.S. Pat. No. 7,384,557. An example of fluidized type flow is described in US Patent Pub. No. 2013/0233772.

The Phase I solvent can be injected into the vessel by way of nozzle-type devices. Nozzle manufacturers are capable of supplying any number of nozzle types based on the type of spray pattern desired.

The contacting of oil sand with Phase I solvent in the contact zone of the extraction vessel is at a pressure and temperature in which at least 20 wt % of the hydrocarbon mixture within the contacting zone of the vessel is in vapor phase during contacting. Preferably, at least 40 wt %, or at least 60 wt % or at least 80 wt % of the hydrocarbon mixture within the contacting zone of the vessel is in vapor phase.

Carrying out the extraction process at the desired conditions using the desired Phase I solvent enables controlling the amount of oil that is extracted from the oil sand. For example, contacting the oil sand with the Phase I solvent in a vessel's contact zone can produce a crude oil composition comprised of not greater than 80 wt %, or not greater than 70 wt %, or not greater than 60 wt %, or not greater than 50 wt % of the bitumen from the supplied oil sand. That is, the Phase I solvent is comprised of a hydrocarbon mix or blend that has the desired characteristics such that the Phase I solvent extraction process can remove or extract not greater than 80 wt %, or greater than 70 wt %, or greater than 60 wt %, or not greater than 50 wt % of the bitumen from the supplied oil sand. This crude oil composition that leaves the extraction zone will also include at least a portion of the Phase I solvent. However, a substantial portion of the Phase I solvent can be separated from the crude oil composition to produce a crude oil product that can be pipelined, transported by other means such as railcar or truck, or further upgraded to make fuel products. The separated Phase I solvent can then be recycled. Since the Phase I extraction process incorporates a relatively light solvent blend relative to the crude oil composition, the Phase I solvent portion can be easily recovered, with little if any external make-up being required.

The bitumen-derived crude oil composition will be reduced in metals and asphaltenes compared to typical processes. Metals content can be determined according to ASTM D5708-11 Standard Test Methods for Determination of Nickel, Vanadium, and Iron in Crude Oils and Residual Fuels by Inductively Coupled Plasma (ICP) Atomic Emission Spectrometry. For example, the crude oil composition can have a nickel plus vanadium content of not greater than 150 wppm, or not greater than 125 wppm, or not greater than 100 wppm, based on total weight of the composition.

As another example, the bitumen-derived crude oil composition can have an asphaltenes content (i.e., heptane insolubles measured according to ASTM D6560) of not greater than 10 wt %, alternatively not greater than 7 wt %, or not greater than 5 wt %, or not greater than 3 wt %, or not greater than 1 wt %, or not greater than 0.05 wt %.

The bitumen-derived crude oil composition can also have a reduced Conradson Carbon Residue (CCR), measured according to ASTM D4530. For example, the crude oil composition can have a CCR of not greater than 15 wt %, or not greater than 10 wt %, or not greater than 5 wt %, or not greater than 3 wt %.

The Phase I extraction is carried out at temperatures and pressures that allow at least a portion of the solvent to be maintained in the vapor phase in the contact zone, in which it is understood that vapor phase conditions in the contact zone are conditions in which the Phase I solvent is below supercritical conditions. In cases in which the Phase I solvent is a mixture of hydrocarbons, operating conditions are such that at least 80 wt %, or at least 90 wt %, or at least 100 wt % of the total Phase I solvent injected into the contact zone is maintained at below supercritical conditions in the contact zone.

Since at least a portion of the Phase I solvent is in the vapor phase in the contact zone, contact zone temperatures and pressures can be adjusted to provide the desired vapor and liquid phase equilibrium. Temperatures higher than the IUPAC established standard temperature of 0° C. is most practical. For example, the contacting of the oil sand and the solvent in the contact zone of the extraction vessel can be carried out at a temperature of at least 20° C., or at least 35° C., or at least 50° C., or at least 70° C. Upper temperature limits depend primarily upon physical constraints, such as contact vessel materials. In addition, temperatures should be limited to below cracking conditions for the extracted crude. Generally, it is desirable to maintain temperature in the contact vessel at not greater than 500° C., alternatively not greater than 400° C. or not greater than 300° C., or not greater than 100° C., or not greater than 80° C.

Pressure in the contact zone can vary as long as the desired amount of hydrocarbon in the solvent remains in the vapor phase in the contact zone. Pressures higher than the IUPAC established standard temperature of 1 bar is most practical. For example, pressure in the contacting zone can be at least 15 psia (103 kPa), or at least 50 psia (345 kPa), or at least 100 psia (689 kPa), or at least 150 psia (1034 kPa). Extremely high pressures are not preferred to ensure that at least a portion of the solvent remains in the vapor phase. For example, the contacting of the oil sand and the solvent in the contact zone of the extraction vessel can be carried out a pressure of not greater than 600 psia (4137 kPa), alternatively not greater than 500 psia (3447 kPa), or not greater than 400 psia (2758 kPa) or not greater than 300 psia (2068 kPa).

The crude oil composition that is removed from the contact zone of the extraction vessel in the Phase I extraction further comprises at least a portion of the Phase I solvent. At least a portion of the Phase I solvent in the oil composition can be separated and recycled for reuse as solvent in the Phase I extraction step. This separated solvent is separated so as to match or correspond within 50%, preferably within 30% or 20% or 10%, of the Hansen solubility characteristics of any make-up Phase I solvent, i.e., the overall generic chemical components and boiling points as described above for the solvent composition. For example, an extracted crude product containing the extracted crude oil and Phase I solvent is sent to a separator and a light fraction is separated from a crude oil fraction in which the separated solvent has each of the Hansen solubility characteristics and each of the boiling point ranges within 50% of the above noted amounts, alternatively within 30% or 20% or 10% of the above noted amounts. This separation can be achieved using any appropriate chemical separation process. For example, separation can be achieved using any variety of evaporators, flash drums or distillation equipment or columns. The separated solvent can be recycled to contact oil sand, and optionally mixed with make-up Phase I solvent having the characteristics indicated above.

Following removal of the bitumen-derived crude oil composition from the extraction vessel, the crude oil composition is separated into fractions comprised of recycle solvent and bitumen-derived crude oil product. The bitumen-derived crude oil product can be relatively high in quality in that it can have relatively low metals and asphaltenes content as described above. The low metals and asphaltenes content enables the crude oil product to be relatively easily upgraded to liquid fuels compared to typical bitumen oils.

The crude oil product will have a relatively high API gravity compared to the bitumen product extracted in a Phase II type solvent extraction. API gravity can be determined according to ASTM D287-92(2006) Standard Test Method for API Gravity of Crude Petroleum and Petroleum Products (Hydrometer Method). The crude oil product can, for example, have an API gravity of at least 8, or at least 10, or at least 12, or at least 14, depending on the exact solvent composition and process conditions.

Extraction of Asphaltene-Containing Bitumen

The oil sand that is provided as feedstock for treatment using a Phase II type solvent can be oil sand that has been mined and not previously solvent-treated (e.g., Phase I extraction using a Phase I solvent) or oil sand that has been treated to remove a significant portion of low-asphaltene crude oil from the total bitumen on the originally mined oil sand. For example, oil sand feedstock provided for Phase II extraction can be oil sand taken from a mining operation or oil sand product or tailings obtained from the Phase I treatment process steps of this invention. Therefore, the Phase II type treatment can be carried out independent of or in conjunction with (e.g., in series with) the Phase I treatment process.

Oil sand feedstock that has been treated to remove at least a portion of the bitumen from mined oil sand can contain from 10% to 60% of the total weight of the bitumen present on the untreated oil sand. For example, the treated oil sand can contain from 15% to 55%, or 20% to 50%, or 25% to 45% of the total weight of the bitumen present on the untreated oil sand.

The oil sand that is provided as feedstock for treatment according to the Phase II extraction steps of this invention can also be oil sand that is low in overall bitumen content relative to the total weight of the oil sand. For example, the oil sand feedstock that is provided for a Phase II type treatment can be comprised of not greater than 8 wt % total bitumen content, based on total weight of the oil sand feedstock. Alternatively, the oil sand feedstock that is provided for a Phase II type treatment can be comprised of not greater than 6 wt % total bitumen content, or not greater than 4 wt % total bitumen content, based on total weight of the oil sand feedstock. The total bitumen content can be measured according to the Dean-Stark method (ASTM D95-05e1 Standard Test Method for Water in Petroleum Products and Bituminous Materials by Distillation).

In the Phase II type extraction, the oil sand provided as feed stock is contacted with a solvent that is different from the solvent used in the Phase I type extraction, since the solvent used in the Phase II type extraction process will be a solvent that more readily solubilizes asphaltenic compounds present on the provided oil sand relative to the solvent used in the Phase I extraction. The Phase II type solvent can be comprised of a hydrocarbon mixture, and the mixture can be comprised of at least two, or at least three or at least four different hydrocarbons.

The Phase II solvent can further comprise hydrogen or inert components. The inert components are considered compounds that are substantially unreactive with the hydrocarbon component or the oil components of the oil sand at the conditions at which the solvent is used in any of the steps of the process of the invention. Examples of such inert components include, but are not limited to, nitrogen and water, including water in the form of steam. Hydrogen, however, may or may not be reactive with the hydrocarbon or oil components of the oil sand, depending upon the conditions at which the solvent is used in any of the steps of the process of the invention.

Treatment of the oil sand with the Phase II solvent can be carried out under conditions in which at least a portion of the Phase II solvent contacts the oil sand in a contact zone of a contactor in the liquid phase. For example, at least 70 wt % of the Phase II solvent in the contact zone can be in the liquid phase. Alternatively, at least 75 wt %, or at least 80 wt %, or at least 90 wt % of the Phase II solvent in the contact zone can be in the liquid phase.

The Phase II solvent is greater in solubility with asphaltenes than the Phase I solvent used to obtain the high quality crude oil. Particularly effective solvents used in the Phase II type extraction of this invention have Hansen solubility parameters higher than that of the solvent used in the Phase I type extraction of this invention. For example, at least one of the Hansen dispersion parameter (D), polarity parameter (P), and hydrogen bonding parameter (H) of the Phase II solvent is higher than that of the Phase I solvent, with none of the Hansen parameters of the Phase II solvent being less than that of the Phase I solvent.

Phase II solvent can be considered solvent that is capable of removing a substantially greater portion of the bitumen from the oil sand than the Phase I solvent that is used to selectively extract a crude oil relatively low in asphaltene content from the bitumen on the oil sand. The Phase II solvent can be comprised of an admixture of a Phase I type solvent and a bitumen-derived crude oil, such as bitumen-derived crude oil extracted using a Phase I type solvent.

A particular example of a Phase II type solvent that is capable of removing a substantially greater portion of the high-asphaltene concentration bitumen than a Phase I type solvent is a solvent comprised of an admixture of a Phase I-type hydrocarbon component and a bitumen-derived crude oil component. Particular examples of Phase I-type aliphatic hydrocarbon components include at least one of $C_3$-$C_6$ paraffins and/or at least one of halogen-substituted $C_1$-$C_6$ paraffins. Examples of particular $C_3$-$C_6$ paraffins include, but are not limited to propane, butane, pentane and hexane, in which the terms "butane," "pentane" and "hexane" refer to at least one linear or branched butane, pentane or hexane, respectively. Examples of $C_1$-$C_6$ halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins. An example of a bitumen-derived oil component is a bitumen-derived crude oil (i.e., crude oil that has been extracted from the oil sand) having an asphaltene content of not greater than 10 wt %, as previously described.

The term "admixture" can mean that the aliphatic compound can be mixed with the bitumen-derived crude oil component prior to adding to the contactor or extraction vessel. Alternatively, the term "admixture" can be understood to mean that aliphatic compound and the bitumen-derived crude oil component can be separately added to the contactor or extraction vessel and mixed within the vessel.

The bitumen-derived crude oil that is mixed with the aliphatic compound can be defined according to Hansen solubility parameters D, P and H, as indicated by the following general equation:

$$HP_{CO}=[(f_A+f_R)(HP_B-HP_{AC})+HP_{AC}]+[f_S/(f_A+f_R)]$$

wherein, $HP_{CO}$=Hansen parameter (D, P or H) of the bitumen-derived crude oil, $f_A$=fraction of aromatics in the bitumen-derived crude oil'

$f_R$=fraction of resins in the bitumen-derived crude oil, $f_S$=fraction of saturates in the bitumen-derived crude oil, $HP_B$=Hansen parameter of oil sand bitumen, and $HP_{AC}$=Hansen parameter of the aliphatic compound.

The aromatics, resins and saturates fractions can be determined according to ASTM D4124-09 Standard Test Method for Separation of Asphalt into Four Fractions, also referred to as a SARA Analysis.

Hansen parameters for bitumens have been published. For example, *Hansen Solubility Parameters: A User's Handbook—2nd Ed.*, Edited by Charles Hansen, CRC Press, 2007, p. 173, indicates that Hansen parameters for Venezuelan crude oil bitumen are as follows: D=18.6; P=3.0; and H=3.4. For purposes of this invention, these Hansen parameters are taken to be representative of Hansen parameters for oil sand.

As an example of the general equation, the Hansen dispersion parameter of the bitumen-derived crude oil can be defined according to the following equation:

$$D_{CO}=[(f_A+f_R)(D_B-D_{AC})+D_{AC}]+[f_S/(f_A+f_R)]$$

The Hansen polarity parameter of the bitumen-derived crude oil can be defined according to the following equation:

$$P_{CO}=[(f_A+f_R)(P_B-P_{AC})+P_{AC}]+[f_S/(f_A+f_R)]$$

The Hansen hydrogen bonding parameter of the bitumen-derived crude oil can be defined according to the following equation:

$$H_{CO}=[(f_A+f_R)(H_B-H_{AC})+H_{AC}]+[f_S/(f_A+f_R)]$$

The aliphatic component (AC) of the solvent can be the same solvent that is used in a Phase I extraction process or it can be different. Preferably, the aliphatic component (AC) of the solvent is the same solvent that is used in a Phase I extraction process.

The Hansen dispersion parameter (D) of the Phase II solvent is desirably at least 14. The Hansen dispersion parameter can be at least 15 or at least 16. For example, Hansen dispersion parameter can range from 14 to 20. Alternatively, the Hansen dispersion parameter of the Phase II solvent can range from 14 to 19, or from 14 to 18, or from 14 to 17.

The Hansen polarity parameter (P) of the Phase II solvent is desirably at least 0.2. The Hansen polarity parameter can be at least 0.4, or 0.6, or 0.8. For example, the Hansen polarity parameter can range from 0.2 to 6. Alternatively, the Hansen polarity parameter of the Phase II solvent can range from 0.2 to 4, or from 0.2 to 3, or from 0.2 to 2.5.

The Hansen hydrogen bonding parameter (H) of the Phase II solvent is desirably at least 0.2. Alternatively, the Hansen hydrogen bonding parameter can be at least 0.4, or at least 0.6, or at least 0.8. For example, the Hansen hydrogen bonding parameter can range from 0.2 to 5. Alternatively, the Hansen hydrogen bonding parameter of the Phase II solvent can range from 0.2 to 4, or from 0.2 to 3, or from 0.2 to 2.5.

$C_3$-$C_6$ paraffins and halogen-substituted $C_1$-$C_6$ paraffins can be used in the Phase II extraction solvent to enhance separation and recycle efficiency, as well as to enhance drying of the tailings solid material. For example, the Phase II solvent can be comprised of at least 5 wt %, or at least 10 wt %, or at least 20 wt %, or at least 30 wt %, of at least one of $C_3$-$C_6$ paraffins and halogen-substituted $C_1$-$C_6$ paraffins, with the overall Phase II solvent composition still meeting the desired Hansen solubility parameters.

The Phase II type of hydrocarbon solvent can be comprised of from 95 wt % to 5 wt % of at least one of the $C_3$-$C_6$ paraffins and halogen-substituted $C_1$-$C_6$ paraffins and from 5 wt % to 95 wt % of the bitumen-derived crude oil. Alternatively, the Phase II type of hydrocarbon solvent can be comprised of from 90 wt % to 20 wt %, or from 80 wt % to 30 wt %, or from 70 wt % to 40 wt % of at least one of the $C_3$-$C_6$ paraffins and halogen-substituted $C_1$-$C_6$ paraffins and from 10 wt % to 80 wt %, or from 20 wt % to 70 wt %, or from 30 wt % to 60 wt % of the bitumen-derived crude oil.

Treatment of the oil sand with the Phase II solvent that contains at least one of the $C_3$-$C_6$ paraffins and halogen-substituted $C_1$-$C_6$ paraffins can be carried out under conditions in which at least a portion of the Phase II solvent contacts the oil sand in a contact zone of a contactor in the vapor phase. For example, at least 5 wt % of the Phase II solvent in the contact zone can be in the vapor phase. Alternatively, at least 10 wt %, or at least 15 wt %, or at least 20 wt % of the Phase II solvent in the contact zone can be in the vapor phase.

The Phase II extraction solvent can contain bitumen-derived crude oil, as well as low-asphaltene or deasphalted crude oil obtained from a refinery process such as distillation or solvent extraction of a mineral oil based crude. For example, the Phase II extraction solvent can be comprised of from 5 wt % to 80 wt %, or 5 wt % to 60 wt %, or 5 wt % to 40 wt %, or 10 wt % to 40 wt % of bitumen-derived and/or deasphalted crude oil.

Phase II solvent that contains low-asphaltene, bitumen-derived and/or deasphalted crude oil can be characterized by a low asphaltenes content. For example, the Phase II solvent can have an asphaltenes content (i.e., heptane insolubles measured according to ASTM D6560) of not greater than 10 wt %, alternatively not greater than 7 wt %, or not greater than 5 wt %, or not greater than 3 wt %, or not greater than 1 wt %, or not greater than 0.05 wt %. Lower asphaltenes content of a crude oil-containing solvent provides an additional benefit in that there can be less plugging of filters and drain lines in the extraction vessel.

The Phase II solvent can be a blend of relatively low boiling point compounds and relatively high boiling point compounds to further enhance separation and recycle efficiency, as well as to enhance drying of the tailings solid material. Since the Phase II solvent can be a blend of low and high boiling compounds, the boiling range of solvent compounds useful according to the Phase II type process can be determined by ASTM D7169-11—Standard Test Method for Boiling Point Distribution of Samples with Residues Such as Crude Oils and Atmospheric and Vacuum Residues by High Temperature Gas Chromatography.

In one embodiment, the Phase II solvent has an ASTM D7169 IBP of not greater than 100° C. Alternatively, the Phase II solvent has an ASTM D7169 IBP of not greater than 80° C. or not greater than 70° C.

The Phase II solvent can have an ASTM D7169 50% distillation point that is significantly higher than the IBP. For example, Phase II solvent can have an ASTM D7169 50% distillation point that is at least 50° C., or at least 80° C., or at least 100° C., or at least 150° C., or at least 200° C. higher than the IBP of the solvent. The Phase II solvent can have an ASTM D7169 50% distillation point within the range of from 100° C. to 450° C., alternatively within the range of from 120° C. to 400° C., or from 140° C. to 300° C.

A high ketone content in the Phase II solvent can be useful but is not necessary. For example, the Phase II solvent can have a ketone content of not greater than 10 wt %, alternatively not greater than 5 wt %, or not greater than 2 wt %, based on total weight of the solvent injected into the extraction vessel. The ketone content can be determined according to test method ASTM D4423-10 Standard Test Method for Determination of Carbonyls in $C_4$ Hydrocarbons.

A high halohydrocarbon content in the Phase II solvent can also be useful but is not necessary. For example, the Phase II solvent can have a halohydrocarbon content of not greater than 10 wt %, alternatively not greater than 5 wt %, or not greater than 2 wt %, based on total weight of the solvent injected into the extraction vessel. The halohydrocarbon content can be determined according to test method ASTM E256-09—Standard Test Method for Chlorine in Organic Compounds by Sodium Peroxide Bomb Ignition.

A high ester content in the Phase II solvent can additionally be useful but is not necessary. For example, the Phase II solvent can have an ester content of not greater than 10 wt %, alternatively not greater than 5 wt %, or not greater than 2 wt %, based on total weight of the solvent injected into the extraction vessel. The ester content can be determined according to test method ASTM D1617-07(2012)—Standard Test Method for Ester Value of Solvents and Thinners.

The Phase II solvent preferably does not include substantial amounts of non-hydrocarbon compounds. Non-hydrocarbon compounds are considered chemical compounds that do not contain any C—H bonds. Examples of non-hydrocarbon compounds include, but are not limited to, hydrogen, nitrogen, water and the noble gases, such as helium, neon and argon. For example, the solvent preferably includes not greater than 20 wt %, alternatively not greater than 10 wt %, alternatively not greater than 5 wt %, non-hydrocarbon compounds, based on total weight of the solvent injected into the extraction vessel.

Solvent to oil sand feed ratios in a Phase II type of extraction can vary according to a variety of variables. Such variables include amount of hydrocarbon mix in the solvent, temperature and pressure of the contact zone, and contact time of hydrocarbon mix and oil sand in the contact zone. Preferably, the solvent and oil sand is supplied to the contact zone of the extraction vessel at a weight ratio of total hydrocarbon in the solvent to oil sand feed of at least 0.01:1, or at least 0.1:1, or at least 0.5:1 or at least 1:1. Very large total hydrocarbon to oil sand ratios are not required. For example, the solvent and oil sand can be supplied to the contact zone of the extraction vessel at a weight ratio of total hydrocarbon in the solvent to oil sand feed of not greater than 4:1, or 3:1, or 2:1.

The bitumen product recovered from the Phase II type extraction can be used as desired. For example, the bitumen product can be sent to a refinery for upgrading to a higher quality petroleum product such as a synthetic crude or for further grading into a transportation fuel such as a component of diesel, jet fuel or gasoline. Alternatively, at least a portion of the bitumen product can be used as an asphalt binder for concrete or roofing materials.

Extraction of bitumen product from oil sand in the Phase II extraction can be carried out in a contact zone of a vessel. For example, a Phase II type of extraction can be carried out in a vessel of a type similar to that described according to the Phase I extraction of crude oil from oil sand. The contacting of the oil sand with the Phase II solvent is at a temperature and pressure to provide the desired solvent vapor and liquid phases within the vessel. Each of the compositional characteristics of the Phase II type solvent described above is based on the total amount of Phase II solvent injected into a contactor vessel. This would include recycle lines in cases in which recycle lines exist.

EXAMPLES

Example 1

Determination of Hansen Parameters of Crude Oil

Oil sands ore from Canada's Athabasca region is crushed and fed to an extraction chamber. The crushed ore is moved through the extraction chamber, while being contacted with propane solvent, representing a Phase I type solvent. The extraction chamber consists of an auger type moving device in which the auger is used to move the particles through the chamber, and the Phase I solvent is injected into the extraction chamber as the particles move through the extraction chamber. An example of the device is depicted in U.S. Pat. No. 7,384,557.

The extraction is carried out at a temperature of 80° F. (27° C.) and a pressure of 148 psia (10.1 atm). Approximately 60 wt % of the bitumen is determined to be extracted from the oil sand, with the remainder of the bitumen staying attached to the oil sand.

Following extraction of the oil from the ore, a mixture of the crude oil and solvent is collected. The solvent is separated from the crude oil by flash evaporation.

The separated crude oil is analyzed. Analytical results are provided in the following Table 1.

TABLE 1

| SARA Characteristics ASTM D4124 | Wt. % |
|---|---|
| Saturates | 37 |
| Aromatics | 25 |
| Resins | 37.5 |
| Asphaltenes | 0.5 |

As shown in Table 1, the oil extracted from the oil sand using propane has only about 0.5 wt % asphaltenes.

Hansen parameters D, P and H are determined for the bitumen-derived crude oil based on the equation:

$$HP_{CO}=[(f_A+f_R)(HP_B-HP_{AC})+HP_{AC}]+[f_S/(f_A+f_R)]$$

wherein, $HP_{CO}$=Hansen parameter (D, P or H) of the bitumen-derived crude oil, $f_A$=fraction of aromatics in the bitumen-derived crude oil (0.25)'

$f_R$=fraction of resins in the bitumen-derived crude oil (0.375), $f_S$=fraction of saturates in the bitumen-derived crude oil (0.37), $HP_B$=Hansen parameter of oil sand bitumen (D=18.6; P=3.0; and H=3.4), and $HP_{AC}$=Hansen parameter of propane (D=13.9; P=0; and H=0).

The Hansen parameters for the bitumen-derived crude oil are determined to be D=17.4; P=2.5; and H=2.7.

Example II

Determination of Hansen Parameters of Phase II Solvent

Phase II type solvents for extracting the remainder of the bitumen on the extracted oil sand in Example 1 are prepared by mixing together varying amounts of propane and the bitumen-derived crude oil described in Example I and varying amounts of pentane and the bitumen-derived crude oil described in Example I. The prepared solvents are as shown in Tables 2 and 3, respectively, which also show the Hansen parameters for the solvents. The Hansen parameters are calculated according to the mathematical mixing rule as previously described, based on the Hansen parameters previously described for propane, pentane, and the estimated values for the bitumen-derived crude oil calculated in Example I.

TABLE 2

| Phase II Solvent Crude/ | Hansen Parameter | | |
|---|---|---|---|
| Propane, wt % | D | P | H |
| 80/20 | 16.7 | 2.0 | 2.2 |
| 50/50 | 15.7 | 1.3 | 1.4 |
| 20/80 | 14.6 | 0.5 | 0.5 |

TABLE 3

| Phase II Solvent Crude/ Pentane, wt % | Hansen Parameter D | P | H |
|---|---|---|---|
| 80/20 | 16.8 | 2.0 | 2.2 |
| 50/50 | 16.0 | 1.3 | 1.4 |
| 20/80 | 15.1 | 0.5 | 0.5 |

It is expected that the solvents having Hansen parameters closer to petroleum bitumen will remove greater amounts of bitumen from the oil sand. Therefore, it is expected that the solvents shown in Table 2 will be increasingly effective in removing the remainder of the bitumen from the oil sand treated in Example 1 as follows: 80/20>50/50>20/80. It is also expected that the solvents shown in Table 3 will be increasingly effective over the solvents shown in Table 2.

The principles and modes of operation of this invention have been described above with reference to various exemplary and preferred embodiments. As understood by those of skill in the art, this invention also encompasses a variety of preferred embodiments within the overall description of the invention as defined by the claims, which embodiments have not necessarily been specifically enumerated herein.

The invention claimed is:

1. A waterless process for producing a bitumen-derived crude oil composition, a heavy bitumen composition and a tailings by-product from a bitumen-containing oil sands feedstock, comprising:

a) treating the bitumen-containing oil sands feedstock with a first hydrocarbon solvent to produce the bitumen-derived crude oil composition and a first hydrocarbon solvent-treated oil sands composition, wherein:
   (i) the bitumen-containing oil sands feedstock is comprised of at least 6 wt % bitumen based on total weight of the bitumen-containing oil sands feedstock, and
   (ii) the first hydrocarbon solvent is comprised of at least one of $C_3$-$C_6$ paraffins and halogen-substituted $C_1$-$C_6$ paraffins;

(b) separating the bitumen-derived crude oil composition from the first hydrocarbon solvent-treated oil sands composition, wherein:
   (i) the bitumen-derived crude oil composition has an asphaltene content of not greater than 10 wt % pentane insolubles, measured according to ASTM D4055, and
   (ii) the first hydrocarbon solvent-treated treated oil sands composition contains from 10% to 60% of the total weight of the bitumen present on the bitumen-containing oil sands feedstock; and (c) treating the first hydrocarbon solvent-treated oil sands composition of step (b) with a second hydrocarbon solvent to produce the heavy bitumen composition and the tailings by-product, wherein the second hydrocarbon solvent is comprised of an admixture of aliphatic hydrocarbon comprised of at least one of $C_3$-$C_6$ paraffins and halogen-substituted $C_1$-$C_6$ paraffins and a fraction of the bitumen-derived crude oil composition.

2. The process of claim 1, wherein the first hydrocarbon solvent has a Hansen hydrogen bonding blend parameter of not greater than 0.5 $MPa^{1/2}$.

3. The process of claim 2, wherein the first hydrocarbon solvent has a Hansen polarity blend parameter of not greater than 1 $MPa^{1/2}$.

4. The process of claim 3, wherein the first hydrocarbon solvent has a Hansen dispersion blend parameter of less than 16 $MPa^{1/2}$.

5. The process of claim 1, wherein the first hydrocarbon solvent has a ketone content of less than 5 wt %.

6. The process of claim 1, wherein the first hydrocarbon solvent has an aromatic content of less than 5 wt %.

7. The process of claim 1, wherein each Hansen solubility parameter of the second hydrocarbon solvent is higher than that of the first solvent.

8. The process of claim 1, wherein at least one Hansen solubility parameter of the second hydrocarbon solvent is higher than the corresponding Hansen solubility parameter of the first solvent.

9. The process of claim 1, wherein at least one Hansen solubility parameter of the second hydrocarbon solvent is higher than the corresponding Hansen solubility parameter of the first solvent, and none of the Hansen solubility parameters of the second solvent is less than the corresponding Hansen parameter of the first solvent.

10. The process of claim 1, wherein the second hydrocarbon solvent has a Hansen hydrogen bonding blend parameter of at least 0.2 $MPa^{1/2}$.

11. The process of claim 1, wherein the second hydrocarbon solvent has a Hansen polarity blend parameter of at least 0.2 $MPa^{1/2}$.

12. The process of claim 1, wherein the second hydrocarbon solvent has a Hansen dispersion blend parameter of at least 14 $MPa^{1/2}$.

13. The process of claim 1, wherein the bitumen-derived crude oil composition has a nickel plus vanadium content of not greater than 150 wppm.

14. The process of claim 1, wherein the bitumen-derived crude oil composition has a Conradson Carbon Residue of not greater than 10 wt %.

15. The process of claim 1, wherein the bitumen-derived crude oil composition has an API gravity of at least 10.

16. The process of claim 1, wherein the hydrocarbon solvent is comprised of from 95 wt % to 5 wt % of the at least one of $C_3$-$C_6$ paraffins and halogen-substituted $C_1$-$C_6$ paraffins and from 5 wt % to 95 wt % of the bitumen-derived crude oil.

17. The process of claim 16, wherein the hydrocarbon solvent is comprised of from 95 wt % to 5 wt % of the at least one of propane, butane, pentane and hexane, and from 5 wt % to 95 wt % of the bitumen-derived crude oil.

18. The process of claim 17, wherein the hydrocarbon solvent is comprised of from 95 wt % to 5 wt % of pentane and from 5 wt % to 95 wt % of the bitumen-derived crude oil.

19. A waterless process for producing a heavy bitumen composition and a tailings by-product from a bitumen-containing oil sands feedstock, comprising:

(a) treating the bitumen-containing oil sands feedstock with a hydrocarbon solvent to produce the heavy bitumen composition and the tailings by-product, wherein:
   (i) the bitumen-containing oil sands feedstock is comprised of not greater than 8 wt % total bitumen content, and
   (ii) the hydrocarbon solvent is comprised of an admixture at least one of $C_3$-$C_6$ paraffins and halogen-substituted $C_1$-$C_6$ paraffins and a bitumen-derived crude oil composition having an asphaltene content of not greater than 10 wt %; and (b) separating the heavy bitumen composition from the tailings by-product.

20. The process of claim 19, wherein the hydrocarbon solvent has a Hansen hydrogen bonding blend parameter of at least 0.2 $MPa^{1/2}$.

21. The process of claim 20, wherein the hydrocarbon solvent has a Hansen polarity blend parameter of at least 0.2 $MPa^{1/2}$.

22. The process of claim 21, wherein the hydrocarbon solvent has a Hansen dispersion blend parameter of at least 14 $MPa^{1/2}$.

23. The process of claim 19, wherein the hydrocarbon solvent is comprised of from 95 wt % to 5 wt % of the at least one of $C_3$-$C_6$ paraffins and halogen-substituted $C_1$-$C_6$ paraffins and from 5 wt % to 95 wt % of the bitumen-derived crude oil.

24. The process of claim 23, wherein the hydrocarbon solvent is comprised of from 95 wt % to 5 wt % of the at least one of propane, butane, pentane and hexane, and from 5 wt % to 95 wt % of the bitumen-derived crude oil.

25. The process of claim 24, wherein the hydrocarbon solvent is comprised of from 95 wt % to 5 wt % of pentane and from 5 wt % to 95 wt % of the bitumen-derived crude oil.

26. The process of claim 25, wherein the hydrocarbon solvent has a Hansen hydrogen bonding blend parameter of at least 0.2 $MPa^{1/2}$.

27. The process of claim 26, wherein the hydrocarbon solvent has a Hansen polarity blend parameter of at least 0.2 $MPa^{1/2}$.

28. The process of claim 27, wherein the hydrocarbon solvent has a Hansen dispersion blend parameter of at least 14 $MPa^{1/2}$.

29. The process of claim 19, wherein the hydrocarbon solvent has an ASTM D7169 IBP of not greater than 100° C.

30. The process of claim 19, wherein the hydrocarbon solvent has an ASTM D7169 50% distillation point within the range of from 100° C. to 450° C.

31. The process of claim 19, wherein the bitumen-derived crude oil composition has a nickel plus vanadium content of not greater than 150 wppm.

32. The process of claim 19, wherein the bitumen-derived crude oil composition has a Conradson Carbon Residue of not greater than 10 wt %.

33. The process of claim 19, wherein the bitumen-derived crude oil composition has an API gravity of at least 10.

* * * * *